US010639558B2

(12) United States Patent
Horikoshi

(10) Patent No.: US 10,639,558 B2
(45) Date of Patent: May 5, 2020

(54) SPINNING TOP LAUNCHING DEVICE

(71) Applicant: TOMY Company, Ltd., Tokyo (JP)

(72) Inventor: Kenji Horikoshi, Tokyo (JP)

(73) Assignee: TOMY Company, Ltd., Tokyo (JP)

( * ) Notice: Subject to any disclaimer, the term of this patent is extended or adjusted under 35 U.S.C. 154(b) by 6 days.

(21) Appl. No.: 15/699,282

(22) Filed: Sep. 8, 2017

(65) Prior Publication Data

US 2018/0214783 A1 Aug. 2, 2018

(30) Foreign Application Priority Data

Feb. 1, 2017 (JP) ..... 2017-016632

(51) Int. Cl.
*A63H 1/04* (2006.01)
*A63H 1/02* (2006.01)
*A63H 31/06* (2006.01)

(52) U.S. Cl.
CPC ..... *A63H 1/04* (2013.01); *A63H 1/02* (2013.01); *A63H 31/06* (2013.01)

(58) Field of Classification Search
CPC ... A63H 1/04; A63H 1/06; A63H 1/28; A63H 1/22; A63H 1/02; A63H 1/00; A63H 29/00
See application file for complete search history.

(56) References Cited

U.S. PATENT DOCUMENTS 4,483,096 A * 11/1984 Gabler ..... A63H 29/24 446/430
4,540,376 A * 9/1985 Turbowitz ..... A63H 17/00 446/164
4,618,330 A * 10/1986 Abe ..... A63H 1/06 446/236
4,946,417 A * 8/1990 Ishikawa ..... A63H 17/22 446/430
5,480,333 A * 1/1996 Larson ..... A63H 30/00 104/295
5,518,437 A * 5/1996 Nonaka ..... A63H 1/02 446/259
5,525,086 A * 6/1996 Gentile ..... A63H 27/10 446/234

(Continued)

FOREIGN PATENT DOCUMENTS

JP 3098449 U 3/2004

*Primary Examiner* — Melba Bumgarner
*Assistant Examiner* — Amir A Klayman
(74) *Attorney, Agent, or Firm* — IP Business Solutions, LLC

(57) ABSTRACT

A spinning top launching device includes a casing; an operation member; a driving wheel being configured to be rotated around a shaft thereof as a center by operating the operation member; a holder being configured outside the casing to hold releasably a spinning top; a power transmission mechanism including a power transmission element, being connected with both the driving wheel and the holder, and being configured to transmit a rotation of the driving wheel to the holder; and a rotation direction switching member being configured to switch a rotation direction of the holder between a first direction and a second direction being opposite to the first direction by moving the power transmission element between a first revolution position and a second revolution position.

14 Claims, 6 Drawing Sheets

(56) References Cited

U.S. PATENT DOCUMENTS

| | | | | |
|---|---|---|---|---|
| 6,406,349 | B1 * | 6/2002 | Chung | A63H 1/04 446/233 |
| 6,746,300 | B1 * | 6/2004 | Matsukawa | A63H 1/06 446/256 |
| 6,805,609 | B1 * | 10/2004 | Paukert | A63H 17/00 446/429 |
| 7,727,047 | B2 * | 6/2010 | Lopez | A63H 27/14 446/41 |
| 9,968,860 | B2 * | 5/2018 | Shindo | A63H 1/04 |
| 2002/0094749 | A1 * | 7/2002 | Chung | A63H 1/04 446/235 |
| 2007/0295124 | A1 * | 12/2007 | Fleytman | E05F 11/423 74/89.21 |
| 2008/0242193 | A1 * | 10/2008 | Filoseta | A63H 18/14 446/429 |
| 2009/0117821 | A1 * | 5/2009 | Ogihara | A63H 18/14 446/429 |
| 2009/0325457 | A1 * | 12/2009 | Zilberberg | A63H 1/06 446/256 |
| 2010/0159798 | A1 * | 6/2010 | Bertrand | A63H 1/02 446/259 |
| 2011/0113910 | A1 * | 5/2011 | Lee | H02K 7/1853 74/333 |
| 2011/0177750 | A1 * | 7/2011 | Ujita | A63H 1/04 446/263 |
| 2015/0017872 | A1 * | 1/2015 | Choi | A63H 1/04 446/259 |
| 2015/0140895 | A1 * | 5/2015 | Huang | A63H 29/22 446/429 |
| 2015/0150229 | A1 * | 6/2015 | Umezawa | A01K 89/0117 242/258 |
| 2016/0310854 | A1 * | 10/2016 | Kubo | A63H 1/04 |

* cited by examiner

SPINNING TOP LAUNCHING DEVICE

CROSS-REFERENCE TO RELATED APPLICATIONS

The present application claims priority under 35 U.S.C. 119 to Japanese Patent Application No. 2017-016632, filed on Feb. 1, 2017. The contents of this application are incorporated herein by reference in their entirety.

BACKGROUND OF THE INVENTION

Field of the Invention

The present invention relates to a spinning top launching device.

Description of the Related Art

Conventionally, it was well-known that a toy was provided with a spinning device (spinning top launching toy) including a spinning top for clockwise-direction rotation, a spinning top for counterclockwise-direction rotation, and a spinning mechanism which rotated the spinning top in a clockwise direction or a counterclockwise direction as described in Japanese Registered Utility Model Application Publication No. 3098449.

According to the aforementioned spinning top launching toy, a user selected either one of the spinning top for clockwise-direction rotation and the spinning top for counterclockwise-direction rotation, and depending on the spinning top, the rotational direction of the spinning top could be freely selected, so that when the user played a spinning tops combat game, it enhanced strategical characteristics.

According to the spinning top launching toy described in Japanese Registered Utility Model Application Publication No. 3098449, a rack belt was used as an operation member, and an opening part for clockwise-direction rotation and an opening part for counterclockwise-direction rotation were formed in a casing. An opening part to which the rack belt was introduced was changed depending on whether in the clockwise direction or the counterclockwise direction the spinning top was to be rotated.

However, according to such spinning top launching device, every time the rack belt was introduced, the user had to confirm the opening part to which the rack belt was introduced and the direction of the rack belt. That was troublesome.

On the other hand, instead of the rack belt, in a case in which a holder was rotated by pulling a string, which was wound around a driving wheel, and rotating the driving wheel on which a coil spring was mounted, such configuration could not be employed because the winding direction of the string, which was wound around the driving wheel, was fixed, and when the string was pulled, the driving wheel and also the holder were rotated in only one direction.

The description herein of advantages and disadvantages of various features, embodiments, methods, and apparatus disclosed in other publications is in no way intended to limit the present invention. For example, certain features of the preferred described embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The disclosed embodiments of the present invention have been developed in view of the above-mentioned and/or other problems in the related art. The disclosed embodiments of the present invention can significantly improve upon existing methods and/or apparatuses.

The present invention was created considering the aforementioned conventional status. An object is to provide a spinning top launching toy which is easy to handle and rotates a spinning top in both directions.

In some embodiments of the present disclosure, a spinning top launching device includes a casing; an operation member; a driving wheel being configured to be rotated around a shaft thereof as a center by operating the operation member; a holder being configured outside the casing to hold releasably a spinning top; a power transmission mechanism including a power transmission element, being connected with both the driving wheel and the holder, and being configured to transmit a rotation of the driving wheel to the holder; and a rotation direction switching member being configured to switch a rotation direction of the holder between a first direction and a second direction being opposite to the first direction by moving the power transmission element between a first revolution position and a second revolution position.

In some embodiments of the present disclosure, in the spinning top launching device as recited above, the power transmission mechanism includes an input gear and an output gear, the input gear is configured to be rotated coaxially and integrally with the driving wheel, the output gear is configured to be rotated coaxially and integrally with the holder, the power transmission element includes first, second, and third gears, the power transmission mechanism is configured to transmit the rotation from the driving wheel to the holder via the first and third gears in order to rotate the holder in the first direction, the power transmission mechanism is configured to transmit the rotation from the driving wheel to the holder via the second gear in order to rotate the holder in the second direction.

In some embodiments of the present disclosure, in the spinning top launching device as recited above, the first and second gears are integrally formed with and always engaged with the input gear, and are rotatable around the shaft of the driving wheel as a center.

In some embodiments of the present disclosure, in the spinning top launching device as recited above, a lock mechanism is configured to restrict the first gear and the second gear to be at the first revolution position or the second revolution position.

In some embodiments of the present disclosure, in the spinning top launching device as recited above, the rotation direction switching member includes an operating body, the operating body is connected to the input gear, and the lock mechanism locks the operating body.

In some embodiments of the present disclosure, in the spinning top launching device as recited above, the driving wheel includes a coil spring, the operation member includes a string being connected to the driving wheel at one end thereof, and the string is wound on the driving wheel in a state in which an energizing force of the coil spring is stored.

In some embodiments of the present disclosure, in the spinning top launching device as recited above, the operation member includes a rack belt having rack tooth and is detachable from the driving wheel, and a pinion gear being configured on the driving wheel to be engaged with the rack tooth, and the driving wheel is configured to be rotated by operating the rack belt.

In some embodiments of the present disclosure, in the spinning top launching device as recited above, the first gear is always engaged with the input gear.

In some embodiments of the present disclosure, in the spinning top launching device as recited above, the third gear is always engaged with the first gear.

In some embodiments of the present disclosure, in the spinning top launching device as recited above, the third gear is always engaged with the output gear.

According to the aforementioned spinning top launching device, as long as the predetermined power transmission element is moved to a predetermined position by the operation part, the holder and also the spinning top can be easily rotated in the clockwise direction or the counterclockwise direction, selectively by only performing the same operation by the operation member.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

DETAILED DESCRIPTION

In the following paragraphs, some embodiments of the invention will be described by way of example and not limitation. It should be understood based on this disclosure that various other modifications can be made by those in the art based on these illustrated embodiments.

Hereinafter, embodiments of the present invention will be described.

[Outline]

Figure 1:
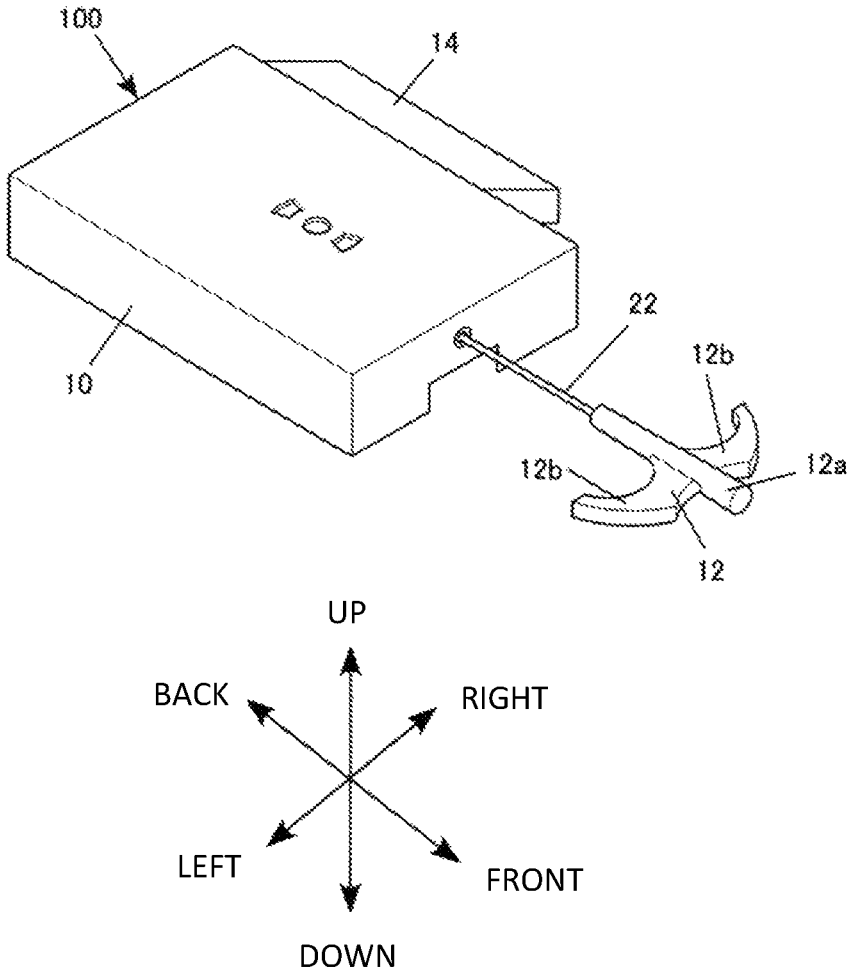
FIG. 1 is a perspective view, which is viewed from an upper surface side, showing a spinning top launching toy according to the present embodiment.
Figure 2:
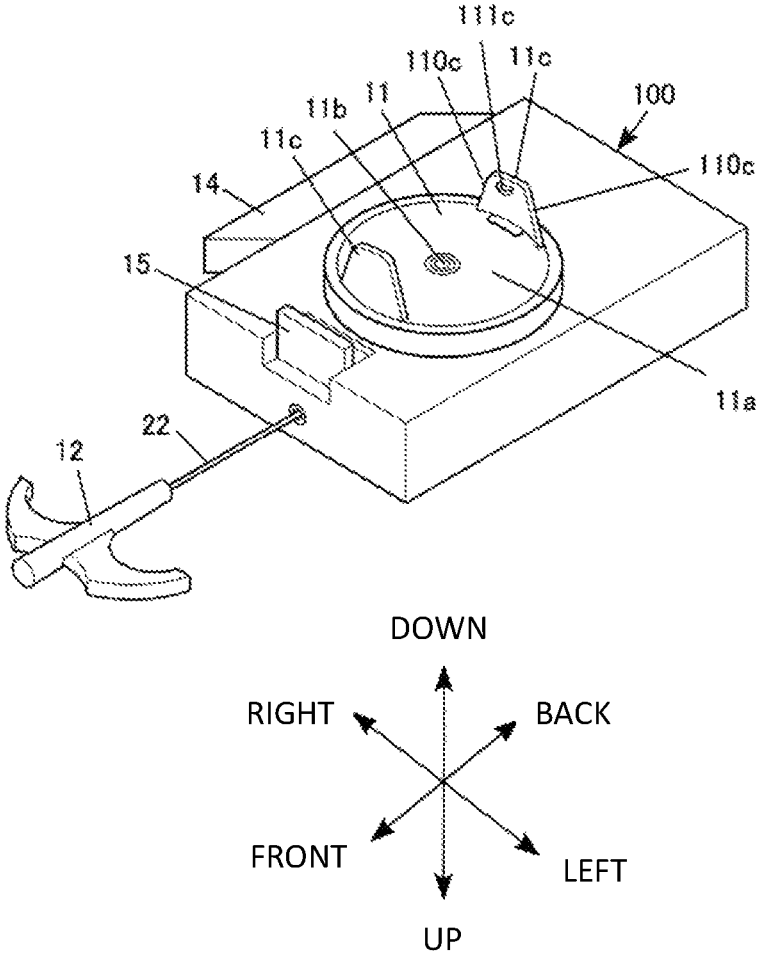
FIG. 2 is a perspective view, which is viewed from a lower surface side, showing a spinning top launching toy according to the present embodiment.
Figure 3:
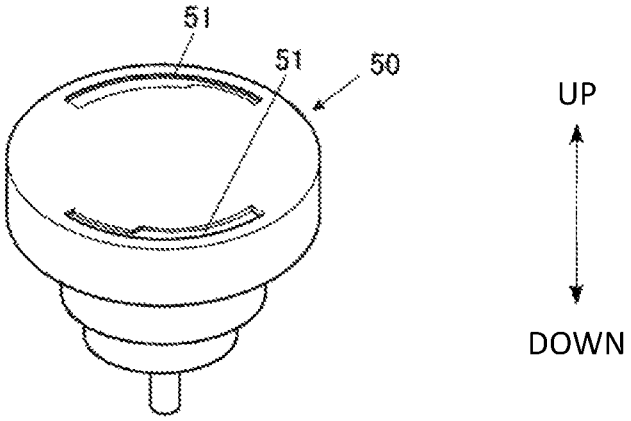
FIG. 3 is a perspective view, which is viewed from an upper surface side, showing a spinning top.

FIG. 1 is a perspective view, which is viewed from an upper surface side, showing a spinning top launching device; FIG. 2 is a perspective view, which is viewed from a lower surface side, showing a spinning top launching toy; and FIG. 3 is a perspective view, which is viewed from an upper surface side, showing a spinning top.

First, the outline of the spinning top launching device 100 in an embodiment will be described.

In the spinning top launching device 100, in a case in which a spinning top 50 is to be rotated in a clockwise direction when viewed from the top, after the spinning top 50 is held by a holder 11 in a state in which the switching lever (e.g., rotation direction switching member) 14 is moved to a back side of a casing 10, a driving lever 12 is pulled hard onto the front side in a state in which the spinning top 50 is directed to a field. Then, the spinning power is applied to the spinning top 50 in the clockwise direction by the rotation of the holder 11, and the spinning top 50 is launched toward the field at the point in which the driving lever 12 is pulled to the end.

On the other hand, in the spinning top launching device 100, in a case in which the spinning top 50 is rotated in the counterclockwise direction when viewed from the top, after the spinning top 50 is held by a holder 11 in a state in which the switching lever 14 is moved to the front side of the casing 10, the driving lever 12 is pulled hard onto the front side in a state in which the spinning top 50 is directed to the field. Then, the spinning power is applied to the spinning top 50 in the counterclockwise direction, and the spinning top 50 is launched toward the field at the point in which the driving lever 12 is pulled to the end.

Further, the operating the switching lever 14 and holding the spinning top 50 may be in reverse order.

Hereinafter, the detail of the spinning top launching device 100 in the embodiment will be described.

[Detailed Structure]

1. External Appearance

The shape of the casing 10 is not particularly limited to a rectangular shape, but the casing may be formed in a size which is possible to hold by one hand.

On the lower surface of the casing 10, the holder 11 which is capable of holding and releasing the spinning top 50 is provided. The holder 11 is provided with a circular plate 11*a* which has a circular shape when viewed from the lower surface. The circular plate 11*a* is fixed to a shaft 11*b* which is positioned in the center of the circular plate. In the outer peripheral part of the lower surface of the circular plate 11*a*, the fork pieces 11*c*, which are extending vertically and downwardly, are positioned facing each other across the shaft 11*b*. Each fork piece 11*c* is formed in an arcuate shape when viewed from the lower surface, and the edges 110*c*, 110*c* in both sides of the circumferential direction of the circular plate 11*a* are inclined with respect to the lower surface of the circular plate 11*a* so that each fork piece 11*c* is formed in a trapezoidal shape. Further, a locking projection 111*c* is formed in the inner surface of each fork piece 11*c*.

When the spinning top 50 is held in the holder 11, each fork piece 11*c* is inserted to each slit 51 of the upper surface of the body part of the spinning top 50 as shown in FIG. 3. In this case, the width of one end side, which corresponds to the rotation direction of the spinning top 50, of each slit 51 of the spinning top 50 is wider than the other end side as shown in FIG. 3, so that each fork piece 11*c* is inserted to the wide side of each slit 51. After that, when the spinning top 50 is rotated with respect to the holder 11 in a direction of moving each fork piece 11*c* to the narrow side of each slit 51, the locking projection 111*c* slides under the edge of the narrow side of each slit 51. Accordingly, the spinning top 50 is held in the holder 11. In this state, when the holder 11 is rotated in a direction opposing to the rotation direction of the aforementioned spinning top 50, the spinning power is applied to the spinning top 50. After that, when the rotation of the holder 11 stops, the spinning top 50 only spins with inertia force. Each fork piece 11*c* moves from the narrow side of each slit 51 to the wide side, and one edge 110*c* of each fork piece 11*c* slides and contacts with the tip edge of the wide side of each slit 51, so that the holding is released and the spinning top 50 is launched.

A driving lever 12 is provided in the front side surface of the casing 10. The driving lever 12 is provided with a basic shaft 12*a* and finger hooking parts 12*b*, 12*b* which overhang in a direction separating each other from two positions facing across the center of the basic shaft 12*a*. A top end of a string 22, which will be described later, is connected with the basic shaft 12*a*.

A switching lever 14 is provided in the right side surface of the casing 10. The switching lever 14 is used for switching the rotation direction of the holder 11. The switching lever 14 is configured to be movable in the front and back direction of the casing 10.

A lock lever 15 is provided in the lower surface of the casing 10. The lock lever 15 is used for locking the operation of the switching lever 14. The lock lever 15 is configured to be movable in the front and back direction of the casing 10.

2. Internal Mechanism (Driving Mechanism)

Figure 4:
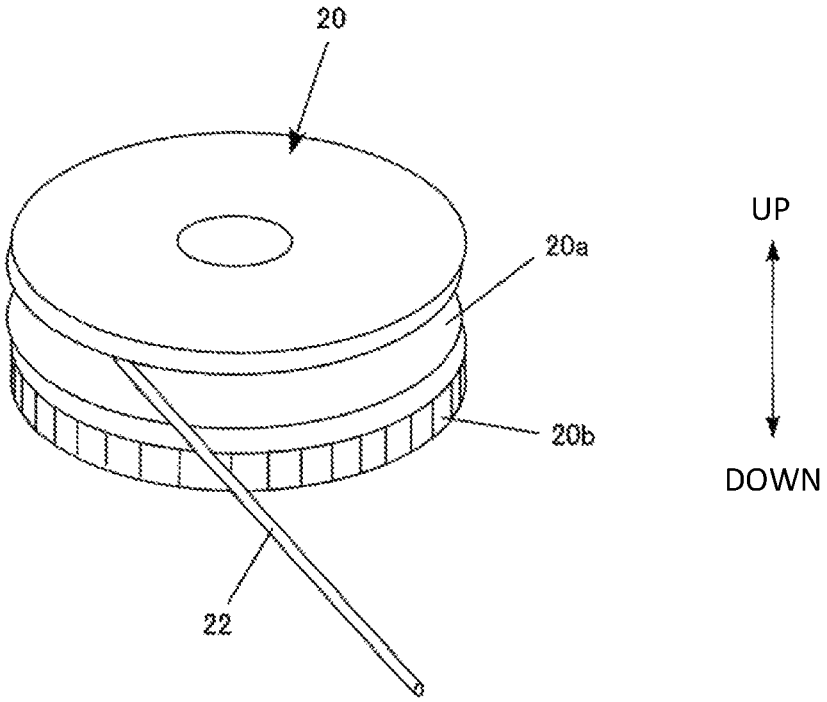
FIG. 4 is a perspective view, which is viewed from an upper surface side, showing a driving wheel.
Figure 6:
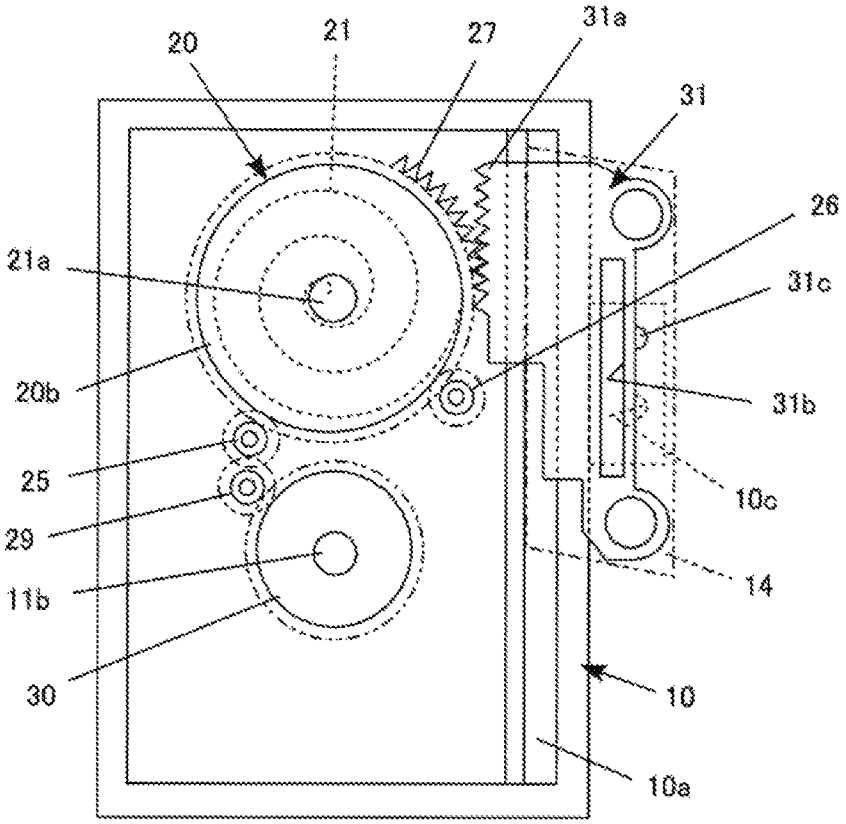
FIG. 6(A) shows a driving mechanism and a switching mechanism of the present embodiment, and is a plane view showing a case in which a movable gear is positioned in the first revolution position.
FIG. 6(B) shows the driving mechanism and the switching mechanism of the present embodiment, and is the plane view showing the case in which the movable gear is positioned in the second revolution position.
Figure 6:
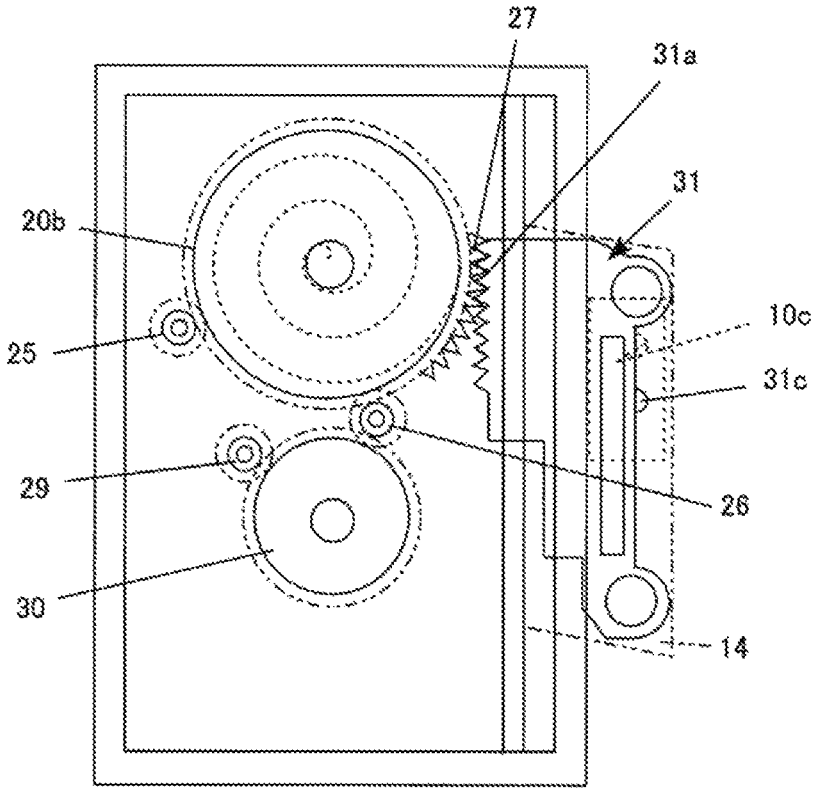

A driving wheel 20 as shown in FIG. 4 is provided inside the casing 10. As shown in FIG. 6, the driving wheel 20 is a spring gear in which a coil spring 21 is mounted. One end of the coil spring 21 is fixed to a shaft 21*a*, and the other end of the coil spring 21 is fixed on the exterior wall of the driving wheel 20. The driving wheel 20 is freely rotatable with respect to the shaft 21*a*. The driving wheel 20 is mounted to the casing 10 by fixing the shaft 21*a* to the casing 10.

A pulley 20*a* is provided in the upper part of the driving wheel 20. The base end of the string 22 which is an operation member is fixed to the pulley 20*a*. The string 22 is wound on the pulley 20*a* and is passed through a hole, which is not shown, in the casing 10, and the tip end of the string 22 is connected to the basic shaft 12*a* of the driving lever 12. With such structure, when the driving lever 12 is pulled, the driving wheel 20 is rotated in one direction, and the coil spring 21 is wound up against the energizing force of the coil spring 21. When the driving lever 12 is released by hand, the driving wheel 20 is rotated in a direction to unwind the coil spring 21 by the energizing force of the coil spring.

(Input Gear and Output Gear)

Figure 5:
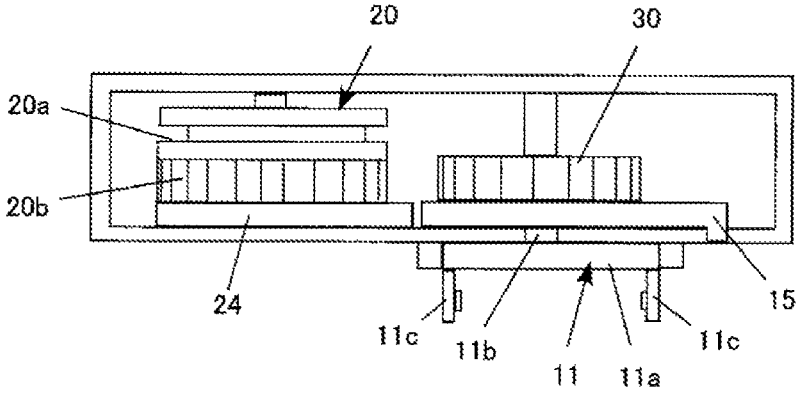
FIG. 5 is a left side view showing an internal mechanism of the spinning top launching toy according to the present embodiment.

An input gear 20*b* is formed in the lower part of the driving wheel 20. Further, an output gear 30 is fixedly provided on the shaft 11*b* of the holder 11 inside the casing 10 (FIG. 5).

(Movable Gear)

Figure 7:
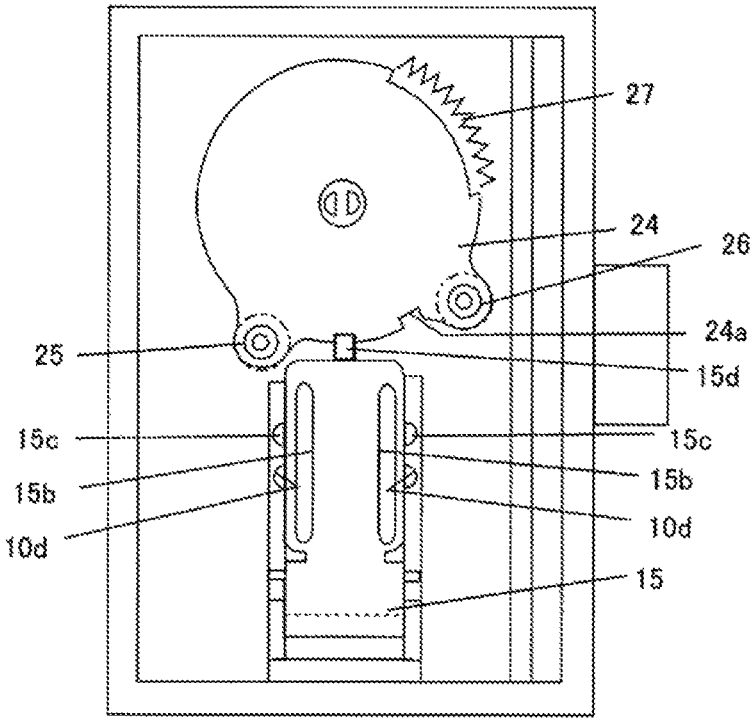
FIG. 7(A) shows a lock mechanism of the present embodiment, and is a plane view showing a case in which a movable gear is positioned in the first revolution position.
FIG. 7(B) shows the lock mechanism of the present embodiment, and is the plane view showing the case in which the movable gear is positioned in the second revolution position.
Figure 7:
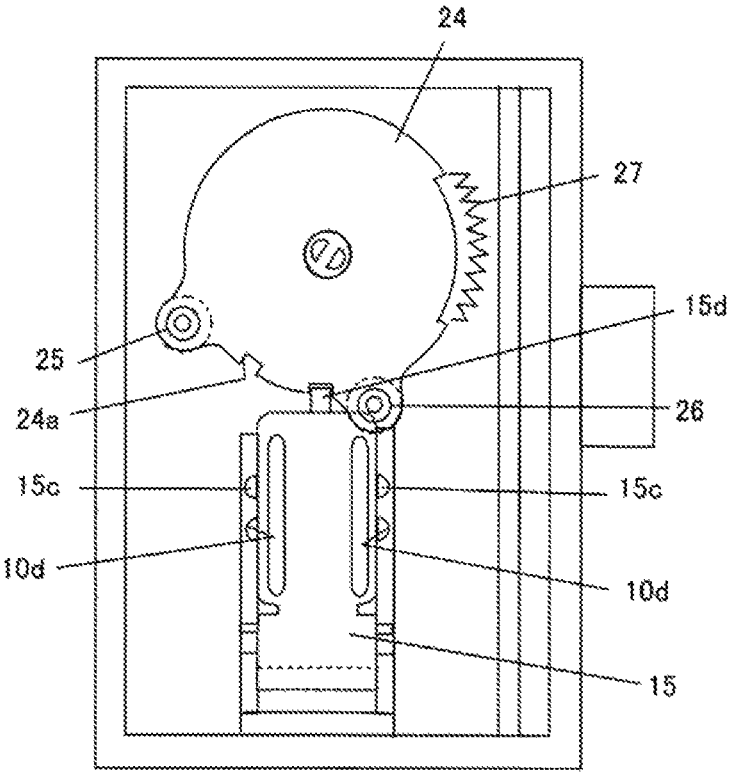

A plate-shaped operating body 24 which is rotatable around the shaft 21*a* as a center is provided in the lower side of the driving wheel 20 (FIG. 7). The first movable gear (planetary gear) 25 and the second movable gear (planetary gear) 26 are provided in the operating body 24. The first movable gear 25 is also denoted as a first gear. Likewise, the second movable gear 26 is also denoted as a second gear. The first movable gear 25 and the second movable gear 26 always mesh with the input gear (sun gear) 20*b*, and they are rotated around the input gear 20*b* in accordance with the movement of the operating body 24. The first movable gear 25 meshes with both the input gear 20*b* in the first revolution position and a gear 29 which always meshes with the output gear 30 (FIG. 6(A)). The gear 29 is also denoted as a third gear. With such structure, the holder 11 becomes rotatable in the clockwise direction in the top view. On the other hand, the second movable gear 26 meshes with both the input gear 20*b* and the output gear 30 in the second revolution position (FIG. 6(B)). With such structure, the holder 11 becomes rotatable in the counterclockwise direction in the top view.

(Switching Mechanism)

In the aforementioned operating body 24, an arcuate-shaped partial gear (intermittent gear) 27 is provided. On the other hand, the switching lever 14 which is the rotation direction switching member moves in the front and back direction along the rail 10*a* formed in the side surface of the casing 10. The switching lever 14 includes the upper frame and the lower frame, and inside the switching lever, a rack plate 31 is fixedly provided. A plurality number of tooth 31*a* is formed in one side surface of the rack plate 31. The tooth 31*a* of the rack plate 31 meshes with the tooth of the aforementioned partial gear 27. The operating body 24 is rotated and moved by moving the switching lever 14 back and forth.

Further, a slit 31*b* is provided in the rack plate 31, and the rack plate 31 is elastic in a width direction. A projection 31*c* is formed on one side surface of the rack plate 31 in the width direction. In the predetermined front and back positions of the switching lever 14, the projection 31*c* provides click feeling when it is engaged with a recessed part 10*c* of the casing 10.

(Lock Mechanism)

The lock lever 15 is formed in a plate shape. The lock lever 15 is configured to be movable in the front and back direction.

Slits 15*b* are provided in both sides of the lock lever 15 in the width direction, and the lock lever 15 is elastic in the width direction. Projections 15*c* are formed in both sides of the lock lever 15 in the width direction. In the predetermined front and back positions of the lock lever 15, the projections 15*c* provide click feeling when they are engaged with recessed parts 10*d* of the casing 10. In one end of the lock lever 15, a locking projection 15*d* is provided. The locking projection 15*d* is engaged with one of the two recessed parts 24*a*, 24*a* formed in the circumference of the operating body 24, and the operating body 24 is locked in the first revolution position and the second revolution position (FIG. 7(A) and FIG. 7(B)).

The embodiment of the present invention was described above, but the present invention is not limited to the aforementioned embodiment, and needless to say, various modifications may be made within the scope that does not depart from the essential point of the present invention.

For example, in the aforementioned embodiment, the string-type spinning top launching device 100 is described, but a spinning top launching toy, in which a pinion gear is rotated by using a belt-shaped rack belt being detachable and linearly forming rack tooth in a side surface, and in which the driving wheel 20 is rotated in one direction by the spinning power of the pinion gear, may be applied. In this case, the pinion gear may be provided in the same shaft with the driving wheel 20 or may be provided in a different shaft.

Further, in the aforementioned embodiment, the gear 29 always meshes with the output gear 30, but the gear 29 may be a movable gear and may always mesh with the first movable gear 25 as a gear. It may be integrally moved with the first and second movable gears 25, 26. Likewise, the first and second movable gears 25 26 do not have to always mesh with the input gear 20*b*. It is possible that only one of the first and second movable gears 25, 26 is always meshes with the input gear. It is also possible that the second movable gear 26 and the gear 29 always mesh with the output gear 30.

In addition, in the aforementioned embodiment, the switching lever 14 and the lock lever 15 are configured to perform a linear reciprocating movement, but needless to say, the movement direction is not limited to this.

Further, in the aforementioned embodiment, the power transmission mechanism is configured as the gear mechanism, but a roller, a pulley, or a crank mechanism may be used instead of the gear.

Furthermore, in the aforementioned embodiment, the driving wheel 20 and the holder 30 are spaced apart, but the driving wheel 20 and the holder 30 may be provided in a superposed manner and the driving wheel 20 and the holder 30 may be connected by a gear, or the like.

Furthermore, in the aforementioned embodiment, the first movable gear (planetary gear) 25 and the second movable gear (planetary gear) 26 are provided in the input gear 20*b* side which constitute the power transmission mechanism, and the gear 29 is provided in the output gear 30 side so as to always mesh with the output gear 30 which configures the power transmission mechanism, but it may be reversed.

The terms and descriptions used herein are used only for explanatory purposes and the present invention is not limited to them. Accordingly, the present invention allows various design-changes falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, the terminology "present invention" or "invention" is meant as a non-specific, general reference and may be used as a reference to one or more aspects within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features.

What is claimed is:

1. A spinning top launching device comprising:

a casing;

an operation member;

a driving wheel being configured to be rotated around a shaft thereof as a center by operating the operation member;

a holder being configured outside the casing to hold releasably a spinning top;

a power transmission mechanism including a power transmission element, being connected with both the driving wheel and the holder, and being configured to transmit a rotation of the driving wheel to the holder, the power transmission element including first and second gears; and a rotation direction switching member being configured to switch a rotation direction of the holder between a first direction and a second direction being opposite to the first direction by moving the first gear on a plane between first and second points and moving the second gear on the plane between the third and fourth point, the power transmission element including a third gear, the power transmission mechanism being configured to transmit the rotation from the driving wheel to the holder via the first and third gears in order to rotate the holder in the first direction when the first gear is moved to be in contact with the third gear, the power transmission mechanism being configured to transmit the rotation from the driving wheel to the holder via the second gear in order to rotate the holder in the second direction.

2. The spinning top launching device according to claim 1, wherein the power transmission mechanism includes an input gear and an output gear, the input gear is configured to be rotated coaxially and integrally with the driving wheel, the output gear is configured to be rotated coaxially and integrally with the holder.

3. The spinning top launching device according to claim 2, wherein the first and second gears are integrally formed with and always engaged with the input gear, and are rotatable around the shaft of the driving wheel as a center.

4. The spinning top launching device according to claim 2, further comprising a lock mechanism being configured to restrict the first gear to be at the first point or the second point, and restrict the second gear to be at the third point or the fourth point.

5. The spinning top launching device according to claim 4, wherein the rotation direction switching member includes an operating body, the operating body is connected to the input gear, and the lock mechanism locks the operating body.

6. The spinning top launching device according to claim 1, wherein the driving wheel includes a coil spring, the operation member includes a string being connected to the driving wheel at one end thereof, and the string is wound on the driving wheel in a state in which an energizing force of the coil spring is stored.

7. The spinning top launching device according to claim 1, wherein the operation member includes a rack belt having rack tooth and is detachable from the driving wheel, and a pinion gear being configured on the driving wheel to be engaged with the rack tooth, and the driving wheel is configured to be rotated by operating the rack belt.

8. The spinning top launching device according to claim 2, wherein the first gear is always engaged with the input gear.

9. The spinning top launching device according to claim 8, wherein the third gear is always engaged with the first gear.

10. The spinning top launching device according claim 8, wherein the third gear is always engaged with the output gear.

11. The spinning top launching device according to claim 1, wherein the rotation of the driving wheel is transmitted to the holder via the power transmission element.

12. The spinning top launching device according to claim 1, wherein the rotation direction switching member includes a switch part being slidably configured on an outer surface of the casing to move the first and second gears.

13. The spinning top launching device according to claim 1, wherein the lock mechanism is configured to lock the operating body to prevent the holder from rotating in the first direction when rotating in the second direction is allowed.

14. The spinning top launching device according to claim 1, wherein the holder is configured to be rotated in the first direction when the holder is viewed from a bottom side of the spinning top launching device on which a top is detachably attached, and the holder is configured to be rotated in the second direction when the holder is viewed from the bottom side.

* * * * *